US008459789B2

(12) United States Patent
Yazawa

(10) Patent No.: US 8,459,789 B2
(45) Date of Patent: Jun. 11, 2013

(54) INK-JET RECORDING APPARATUS INCLUDING INTERNAL LIGHT SOURCE

(75) Inventor: Hiroaki Yazawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 139 days.

(21) Appl. No.: 13/039,101

(22) Filed: Mar. 2, 2011

(65) Prior Publication Data

US 2011/0242249 A1 Oct. 6, 2011

(30) Foreign Application Priority Data

Mar. 30, 2010 (JP) ..... 2010-076921

(51) Int. Cl.
*B41J 29/13* (2006.01)

(52) U.S. Cl.
USPC ..... 347/102; 347/108; 358/475

(58) Field of Classification Search
USPC ..... 347/108, 102; 358/475, 509; 399/220
IPC ..... B41J 29/13
See application file for complete search history.

(56) References Cited

U.S. PATENT DOCUMENTS

| | | | | |
|---|---|---|---|---|
| 4,232,964 | A * | 11/1980 | Nodov et al. | 355/70 |
| 5,573,236 | A * | 11/1996 | Petocchi et al. | 271/265.02 |
| 5,616,929 | A * | 4/1997 | Hara | 250/573 |
| 5,808,295 | A * | 9/1998 | Takeda et al. | 250/216 |
| 6,443,546 | B1 * | 9/2002 | Takagi | 347/7 |
| 7,440,144 | B2 * | 10/2008 | Yamaguchi | 358/406 |
| 7,548,352 | B2 * | 6/2009 | Sakurai et al. | 358/475 |
| 7,784,926 | B2 | 8/2010 | Watanabe | |
| 2005/0151811 | A1 | 7/2005 | Shimizu et al. | |
| 2005/0179750 | A1 | 8/2005 | Hayasaki et al. | |
| 2005/0185034 | A1 | 8/2005 | Anma et al. | |
| 2005/0219303 | A1 | 10/2005 | Matsumoto et al. | |

(Continued)

FOREIGN PATENT DOCUMENTS

| | | |
|---|---|---|
| JP | 2002-052778 A | 2/2002 |
| JP | 2003-244362 A | 8/2003 |

(Continued)

OTHER PUBLICATIONS

Japan Patent Office, Notice of Decision of Refusal for Japanese Patent Application No. 2010-076921 (counterpart Japanese patent application), mailed Nov. 27, 2012.

(Continued)

*Primary Examiner* — Manish S Shah
*Assistant Examiner* — Roger W Pisha, II
(74) *Attorney, Agent, or Firm* — Baker Botts L.L.P.

(57) ABSTRACT

An ink jet recording apparatus which jets an ink onto a recording medium to record an image, includes: a housing which has an opening at an upper portion thereof; a carriage which reciprocates in the housing and carries an ink cartridge containing the ink and a recording head for jetting the ink; a tray, at least a portion of which is provided in the housing and on which the recording medium recorded by the ink jetted from the recording head is discharged; a cover which is provided on the upper portion of the housing and opens/closes the opening; and a light source which is provided so that both a carriage area in which the carriage is positioned when the ink cartridge is replaced and a discharge area, of the tray, in which the recording medium is discharged are irradiated with a light from the light source.

13 Claims, 9 Drawing Sheets

U.S. PATENT DOCUMENTS

| | | | | |
|---|---|---|---|---|
| 2006/0087538 | A1 | 4/2006 | Amma et al. | |
| 2006/0092194 | A1 | 5/2006 | Yamaguchi | |
| 2007/0052774 | A1 | 3/2007 | Shimizu et al. | |
| 2007/0195141 | A1 | 8/2007 | Anma et al. | |
| 2007/0268325 | A1 | 11/2007 | Watanabe | |
| 2008/0204529 | A1 | 8/2008 | Matsumoto et al. | |
| 2009/0128609 | A1 | 5/2009 | Matsumoto et al. | |
| 2009/0141056 | A1 | 6/2009 | Nakamura et al. | |
| 2010/0165062 | A1 | 7/2010 | Shimizu et al. | |
| 2010/0208015 | A1 | 8/2010 | Matsumoto et al. | |
| 2010/0302291 | A1 | 12/2010 | Matsumoto et al. | |
| 2010/0309265 | A1 | 12/2010 | Matsumoto et al. | |
| 2010/0309266 | A1 | 12/2010 | Matsumoto et al. | |
| 2011/0037815 | A1 | 2/2011 | Anma et al. | |
| 2011/0228312 | A1* | 9/2011 | Nakamura et al. | 358/1.14 |
| 2012/0127247 | A1 | 5/2012 | Anma et al. | |

FOREIGN PATENT DOCUMENTS

| | | | |
|---|---|---|---|
| JP | 2004-188638 | A | 7/2004 |
| JP | 2005-017786 | A | 1/2005 |
| JP | 3646396 | B2 | 5/2005 |
| JP | 2005-144949 | A | 6/2005 |
| JP | 2005-169895 | A | 6/2005 |
| JP | 2006-129369 | A | 5/2006 |
| JP | 2007-105927 | A | 4/2007 |
| JP | 4125329 | B2 | 7/2008 |
| JP | 2009-006482 | A | 1/2009 |
| JP | 2009-132056 | A | 6/2009 |
| JP | 2009-132157 | A | 6/2009 |
| JP | 2009-291989 | A | 12/2009 |
| JP | 4562150 | B2 | 10/2010 |

OTHER PUBLICATIONS

Japan Patent Office, Notice of Reasons for Rejection for Japanese Patent Application No. 2010-076921 (counterpart Japanese patent application), mailed Sep. 4, 2012.

* cited by examiner

INK-JET RECORDING APPARATUS INCLUDING INTERNAL LIGHT SOURCE

CROSS REFERENCE TO RELATED APPLICATION

The present application claims priority from Japanese Patent Application No. 2010-076921, filed on Mar. 30, 2010, the disclosure of which is incorporated herein by reference in its entirety.

BACKGROUND OF THE INVENTION

1. Field of the Invention

The present invention relates to an ink jet recording apparatus which records an image on a paper by a recording head provided in a housing of the apparatus and discharges the paper on which the image has been recorded to a paper discharge tray provided in the housing.

2. Description of the Related Art

In an ink-jet recording apparatus having both a printer function and a scanner function, a scanner section having the scanner function is generally attached to an upper portion of a printer section having the printer function by a hinged structure. A first housing constructing the printer section accommodates a carriage which carries a recording head and an ink cartridge and at least a part of a paper discharge tray to which a paper having an image recorded thereon is discharged. A second housing constructing the scanner section is provided with a platen glass on which a document is placed and an image sensor which scans the image of the document. In conventional techniques, when the ink cartridge is replaced by a user, the scanner section is rotated by the hinged structure to be lifted up, an opening provided on the upper portion of the first housing is opened, and then, the user puts his/her hand from the opening into an area, in which the carriage is placed, to replace an empty ink cartridge with a new one. Further, in a case of taking out the paper discharged on the paper discharge tray, the user visually confirms the paper from an opening for taking out the paper, which is provided at a front portion of the first housing, and takes out the paper with his/her hand.

However, the scanner section is considerably heavy owing to the platen glass, the image sensor, etc. Thus, an angle formed when the scanner section is lifted up is limited to a small angle for preventing a fall etc. As a result, even when the scanner section is lifted up to open the opening, it is difficult to take sufficient light of room lighting in the area in which the carriage is placed. Due to darkness of this area, the workability when the ink cartridge is replaced by the user is deteriorated.

Furthermore, in a case that a small-sized paper, such as a postcard, is discharged to the paper discharge tray, all or a substantial portion of the small-sized paper is placed inside the housing. It is difficult to take sufficient light of room lighting at the inside of the housing. Accordingly, it is difficult for the user to visually confirm an existence of the small-sized paper from the opening for taking out the paper, thus the workability when the small-sized paper is taken out by the user is deteriorated.

Various techniques for improving "the workability when the ink cartridge is replaced by the user" have been suggested in the past. For example, United States Patent Application Publication No. 2006/0092194 (corresponding to Japanese Patent Application Laid-open No. 2006-129369) describes a structure that a light source mounted on an image scanning section of a scanner unit irradiates an inside of a recording unit with a light through a window provided between the scanner unit and the recording unit. Further, Japanese Patent Application Laid-open No. 2004-188638 describes a structure that an indicating light is irradiated to an ink tank through a transmitting means (hole etc.) provided in a maintenance cover.

In the above related arts (United States Patent Application Publication No. 2006/0092194 and Japanese Patent Application Laid-open No. 2004-188638), the light is irradiated to the recording unit or the ink tank (i.e. ink cartridge), thus, it is possible to improve "the workability when the ink cartridge is replaced by the user". However, the above related arts fail to consider the improvement of "the workability when the paper having the image recorded thereon and stacked on the paper discharge tray is taken out by the user", and the workability still remains unimproved.

SUMMARY OF THE INVENTION

The present invention has been made in order to solve the problem as described above, an object of which is to provide an ink jet recording apparatus which is capable of improving "the workability when the ink cartridge is replaced by the user" as well as "the workability in the case of taking out the paper having the image recorded thereon and stacked on the paper discharge tray".

According to an aspect of the present invention, there is provided an ink-jet recording apparatus which jets an ink onto a recording medium to record an image, including: a housing having an opening at an upper portion thereof; a carriage carrying an ink cartridge which contains the ink and is provided in the housing to be reciprocatively movable and a recording head which jets the ink; a tray, at least a portion of which is provided in the housing and on which the recording medium, on which the image is recorded by jetting the ink from the recording head, is discharged; a lid body which is provided on the upper portion of the housing and opens/closes the opening; and a light source which is provided so that both a carriage area in which the carriage is placed in a case that the ink cartridge is replaced and a discharge area in which the recording medium discharged on the tray is placed are irradiated with a light, wherein: a portion of the discharge area placed in the housing is configured to be seen from the housing; and the light source irradiates, in a state that the lid body is closed, at least the portion of the discharge area with the light and the light source irradiates, in a state that the lid body is opened, at least the carriage area with the light.

In this configuration, the light source irradiates, in a state that the lid body is closed, the portion of the discharge area placed in the housing with the light. Accordingly, the user is easily capable of visually confirming the recording medium discharged to the tray, thus, it is possible to improve the workability when the paper is taken out from the tray. Further, in a state that the lid body is opened, the light source irradiates the carriage area with the light, thus, it is possible to improve the workability when the ink cartridge is replaced by the user.

DRAWINGS

DESCRIPTION OF THE PREFERRED EMBODIMENTS

An explanation will be made below with reference to the drawings about an ink-jet recording apparatus according to a preferred embodiment of the present invention. In the embodiments described below, the present invention is applied to the ink jet recording apparatus (multifunction machine) having the printer function, the scanner function, and the copy function. The present invention, however, is applicable to a simple printer etc. having only the printer function.

Figure 1:
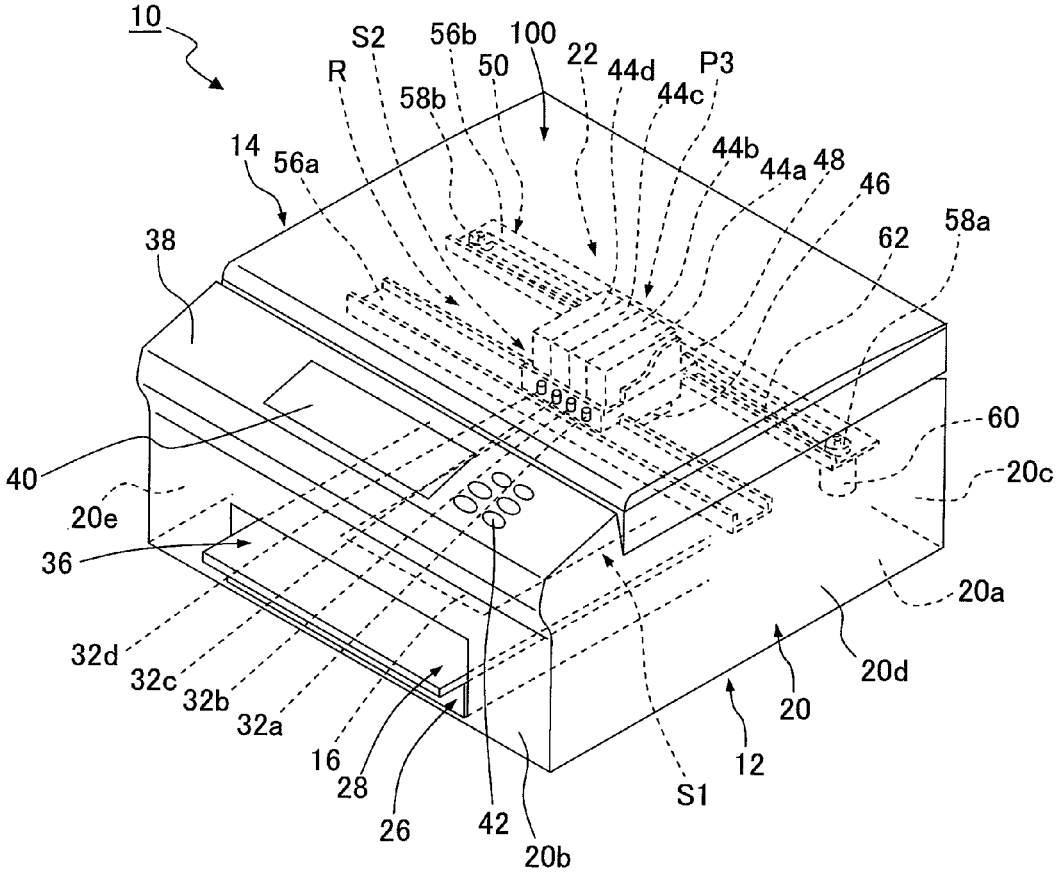
FIG. 1 is a perspective view showing a structure of an ink jet recording apparatus according to a first embodiment.

First, an overall construction of the ink-jet recording apparatus will be described. As shown in FIG. 1, the ink-jet recording apparatus 10 is provided with a printer section 12 having "the printer function" for recording an image onto a paper 16 (recording medium), a scanner section 14 having "the scanner function" for scanning an image of a document. "The copy function" of the ink-jet recording apparatus 10 is fulfilled by recording the image scanned by the scanner section 14 onto the paper 16.

Figure 2:
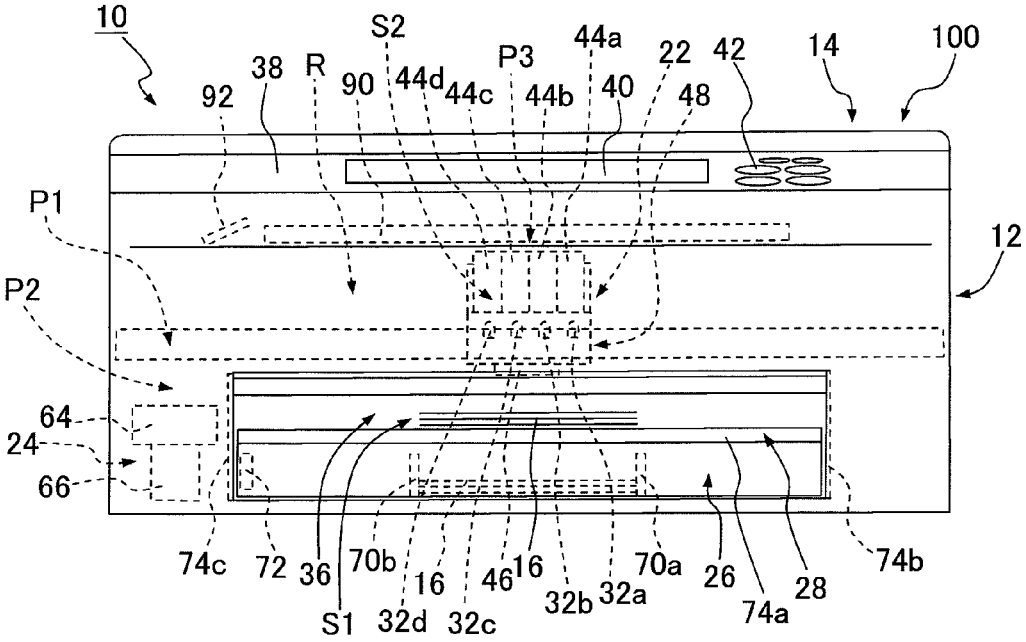
FIG. 2 is a front view showing the structure of the ink jet recording apparatus according to the first embodiment.
Figure 3:
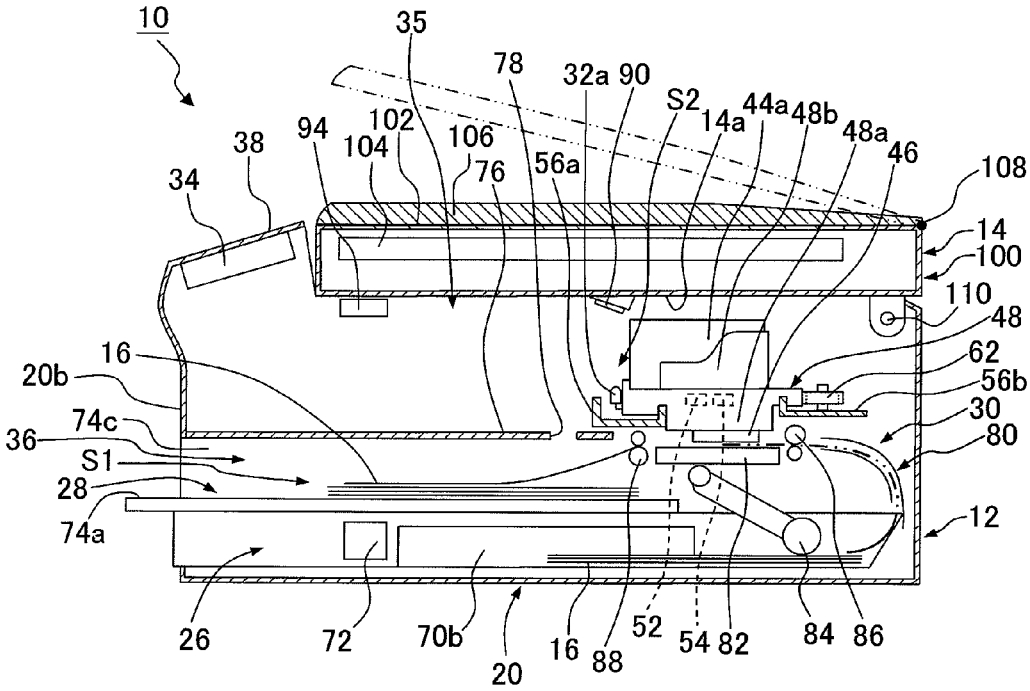
FIG. 3 is a cross-sectional view showing the structure of the ink-jet recording apparatus according to the first embodiment.

Next, a construction of the printer section 12 will be described. As shown in FIGS. 1 to 3, the printer section 12 is provided with a first housing 20 in a substantially rectangular parallelepiped shape. A recording section 22, a capping device 24 (FIG. 2), a paper cassette 26, a paper discharge tray 28 (tray), a transporting section 30 (FIG. 3), light sources 32*a* to 32*d*, and a control section 34 (FIGS. 3 and 4), as "a light source controlling section", are provided inside the housing 20.

As shown in FIG. 1, the first housing 20 includes a bottom plate portion 20*a* which is substantially rectangular as viewed in a plan view, four side plate portions 20*b* to 20*e* rising from a peripheral portion of the bottom plate portion 20*a*. An opening 35 (FIG. 3) is formed in an upper portion of the first housing 20. An opening 36 for taking out the paper is formed in the side plate portion 20*b* forming a front-side surface of the housing 20. An operation section 38 is formed to be inclined by a predetermined angle above the side plate portion 20*b* forming the front-side surface of the housing 20. The operation section 38 is provided with a display panel 40 and various types of input buttons 42. A control section 34 (FIG. 3) is provided inside the first housing 20 and below the operation section 38.

As shown in FIG. 1, the recording section 22 records the image onto the paper 16 based on an image information provided from an external apparatus (computer etc.) or the scanner section 14. The recording section 22 includes a plurality of ink cartridges 44*a* to 44*d* (four cartridges in this embodiment) which contain different colors of ink respectively (four colors in this embodiment, in particular, cyan, yellow, magenta, and black), a recording head 46 which jets the ink supplied from each of the ink cartridges 44*a* to 44*d* onto the paper 16, a carriage 48 which carries the ink cartridges 44*a* to 44*d* and the recording head 46, and a driving section 50 which reciprocates the carriage 48.

As shown in FIG. 3, the carriage 48 includes a head holder 48*a* holding the recording head 46 and a cartridge holder 48*b* removably holding each of the ink cartridges 44*a* to 44*d*. Cartridge sensors 52 and ink remaining amount sensors 54 corresponding to the ink cartridges 44*a* to 44*d* respectively are provided in the cartridge holder 48*b*. Each of the cartridge sensors 52, as "a cartridge detecting section", detects an absence or a presence of one of the ink cartridges. Each of the ink remaining amount sensors 54, as "an ink remaining amount detecting section", detects the ink remaining amount of each of the ink cartridges. The structures of the cartridge sensors 52 and the ink remaining sensors 54 are not specifically limited, publicly known techniques can be appropriately used.

As shown in FIG. 1, the driving section 50 includes a first rail 56*a* and a second rail 56*b* by which the carriage 48 is supported to be able to reciprocate, a driving pulley 58*a* and a driven pulley 58*b* provided to one of the first rail 56*a* and the second rail 56*b* (provided to the second rail 56*b* in this embodiment), a driving motor 60 connected to the driving pulley 58*a*, and an endless belt 62 suspended between the driving pulley 58*a* and the driven pulley 58*b*. A part of the endless belt 62 is fixed to side surface of the carriage 48.

Figure 6:
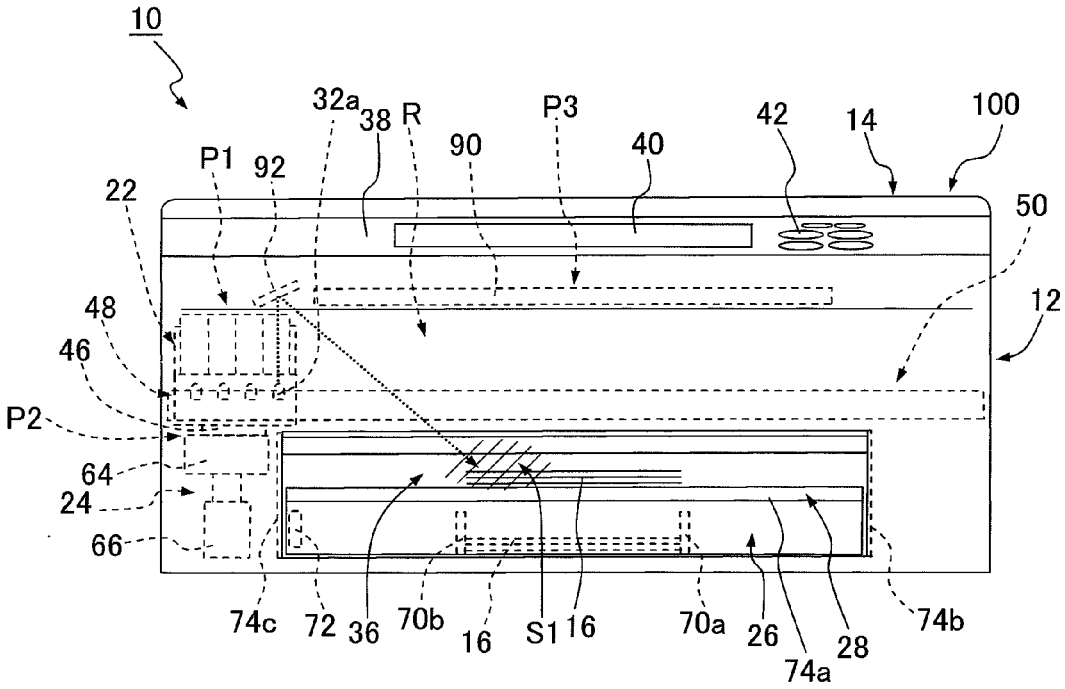
FIG. 6 is a cross-sectional view showing "a standby state" of the ink-jet recording apparatus according to the first embodiment.

As shown in FIG. 1, in a case that the image is recorded onto the paper 16, the driving motor 60 is driven so that the carriage 48 is reciprocated in a scanning area R (that is, the area in which the carriage 48 is capable of moving in a case of recording the image onto the paper 16), along the first rail 56*a* and second rail 56*b*. Further, as shown in FIG. 6, in a case that a purge operation, by which an ink jetting failure of the recording head 46 is recovered, is performed or that the ink-jet recording apparatus 10 is put in a standby state, the driving motor 60 (FIG. 1) is driven to move the carriage 48 to a standby position P1 which is positioned at a side of the scanning area R. Furthermore, as shown in FIG. 2, in a case that each of the ink cartridges 44*a* to 44*d* is replaced, the driving motor 60 (FIG. 1) is driven to move the carriage 48 to a central portion of the scanning area R.

As shown in FIG. 2, the capping device 24 has functions to suck the ink from the recording head 46 in the purge operation and to prevent drying of nozzles (not shown) of the recording head 46 in the standby state. The capping device 24 includes a head cap 64 covering the recording head 46 at a predetermined capping position P2, a lifting section 66 moving up/down the head cap 64, and a suction pump (not shown) sucking the ink.

As shown in FIG. 2, the paper cassette 26 is a case which accommodates the paper 16 of various sizes, such as a postcard, paper of size B5, paper of size A4, etc. Two paper guides 70*a* and 70*b* defining a position of the paper 16 are provided to a bottom portion of the paper cassette 26. A paper size sensor 72, as "a size recognition mechanism", which recognizes the size of the paper 16 is provided at a side portion of the paper cassette 26. The paper guides 70*a* and 70*b* are configured to be positionally adjusted in a direction perpendicular to a transporting direction of the paper 16 (left-right direction in FIG. 2). A pair of the paper guides 70*a* and 70*b* guides both ends of the paper 16. Further, the paper size sensor 72 is configured to output a signal, which depends on the size of the paper 16, based on a space between the paper guides 70*a* and 70*b*.

"The size recognition mechanism" is not limited to the paper size sensor 72. For example, in a case that a user performs a manual input of the paper size, it is possible to use, as "the size recognition mechanism", an input button for inputting the paper size among the various input buttons 42 and the control section 34 recognizing the inputted size. Further, in a case that the ink-jet recording apparatus 10 is used while being connected with the external apparatus (computer etc.), a paper size signal inputted from the external apparatus may be used as a size recognition means.

As shown in FIG. 2, the paper discharge tray 28 includes a plate-shaped tray body 74*a* provided above the paper cassette 26, side plate portions 74*b* and 74*c* provided both sides of the tray body 74*a* in the direction perpendicular to the transporting direction of the paper 16 (left-right direction in FIG. 2). As shown in FIG. 3, there is provided, above the tray body 74*a*, a partition plate 76 which is inserted between an area S1 in which the paper 16 discharged to the paper discharge tray 28 is placed (hereinafter referred to as "a discharge area") and an area above the discharge area S1. An elongated light guide opening 78 (light guide section) guiding the light of each of the light sources 32*a* to 32*d* to the discharge area S1 is formed while extending in a moving direction of the carriage 48 (hereinafter refereed to as "a scanning direction").

Although a substantial portion of the paper discharge tray 28 of this embodiment is placed inside the first housing 20, a portion except the above is placed outside the first housing 20 while protruding from the opening 36 for taking out the paper. As shown in FIG. 3, a portion of the discharge area S1 placed inside the first housing 20 is configured to be seen from outside of the first housing 20 through the opening 36 for taking out the paper. The paper 16 is discharged from above an end portion of the discharge area S1 placed inside the first housing 20 to the paper discharge tray 28.

As shown in FIG. 3, the transporting section 30 transports the paper 16 accommodated in the paper cassette 26 to the recording section 22 at a predetermined timing and discharges the paper 16 on which the image has been recorded to the paper discharge tray 28. The transporting section 30 includes a transport route 80 which is substantially U-shaped in cross-section, a platen 82 supporting the paper 16 at a position facing the recording head 46, a pickup roller 84, a paper feeding roller 86, and a paper discharge roller 88. The paper 16 accommodated in the paper cassette 26 is provided to the transport route 80 by the pickup roller 84, and then the paper 16 is provided to the platen 82 at the predetermined timing by the paper feeding roller 86. The image is recorded onto the paper 16 by the recording head 46 and the paper 16 is discharged to the paper discharge tray 28 by the paper discharge roller 88.

As shown in FIG. 1, each of the light sources 32*a* to 32*d* is a light-emitting section. The light sources 32*a* to 32*d* respectively emit lights of "blue", "yellow", "red", and "green" so as to respectively correspond to colors of ink, "cyan", "yellow", "magenta", and "black", contained in the ink cartridges 44*a* to 44*d*. The light sources 32*a* to 32*d* are provided to the side surface of the carriage 48 so that the light emitted from each of the light sources 32*a* to 32*d* is emitted toward an upward direction to be irradiated for both a carriage area S2 in which the carriage 48 is placed when the ink cartridges 44*a* to 44*d* are replaced and the discharge area S1 in which the paper 16 discharged to the paper discharge tray 28 is placed.

Figure 5:
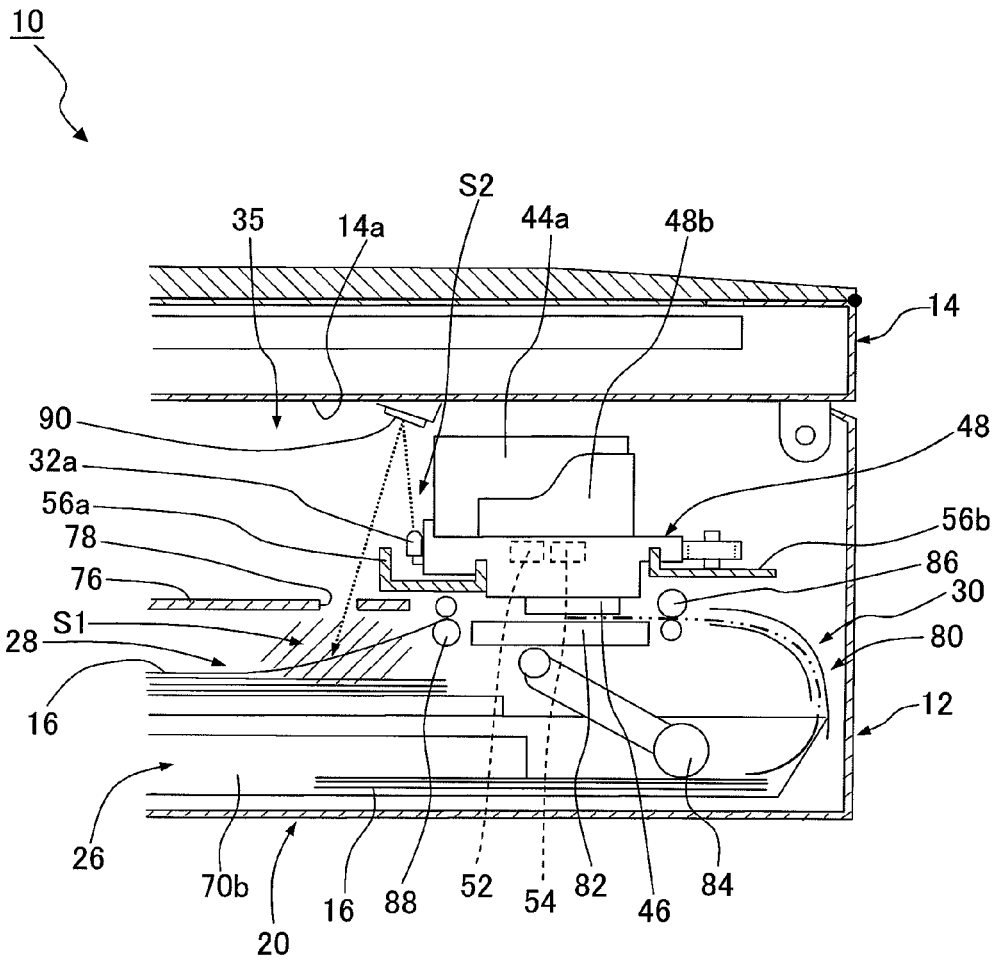
FIG. 5 is a cross-sectional view showing "a state when recording is performed" of the ink-jet recording apparatus according to the first embodiment.

On the other hand, as shown in FIGS. 2 and 3, a light-reflecting member 90, such as a mirror etc., is provided at a lower surface 14*a* of the scanner section 14 facing the carriage area S2 so that the light-reflecting member 90 extends in the scanning direction and is inclined with respect to the transporting direction of the paper 16. As shown in FIG. 5, the light emitted from each of the light sources 32*a* to 32*d* is reflected at the light-reflecting member 90 so as to be irradiated to the discharge area S1 in the first housing 20 through the light guide opening 78 in a state that the opening 35 (FIG. 3) is closed with the scanner section 14.

As shown in FIG. 2, a light-reflecting member 92, such as a mirror etc., is provided at a portion of the lower surface 14*a* of the scanner section 14 facing the capping device 24 so that the light-reflecting member 92 is inclined with respect to the scanning direction of the carriage 48. As shown in FIG. 6, the light emitted from the light source 32*a* is reflected at the light-reflecting member 92 so as to be irradiated to the discharge area S1 in the first housing 20 through the light guide opening 78 in a state that the opening 35 (FIG. 3) is closed with the scanner section 14 and that the carriage 48 is positioned at the standby position P1.

As such, the light is reflected at the light-reflecting member 90 or the light-reflecting member 92 in a predetermined direction in this embodiment. Thus, a light source, such as a light emitting diode etc, having a high directivity, is used as each of the light sources 32*a* to 32*d*.

Figure 4:
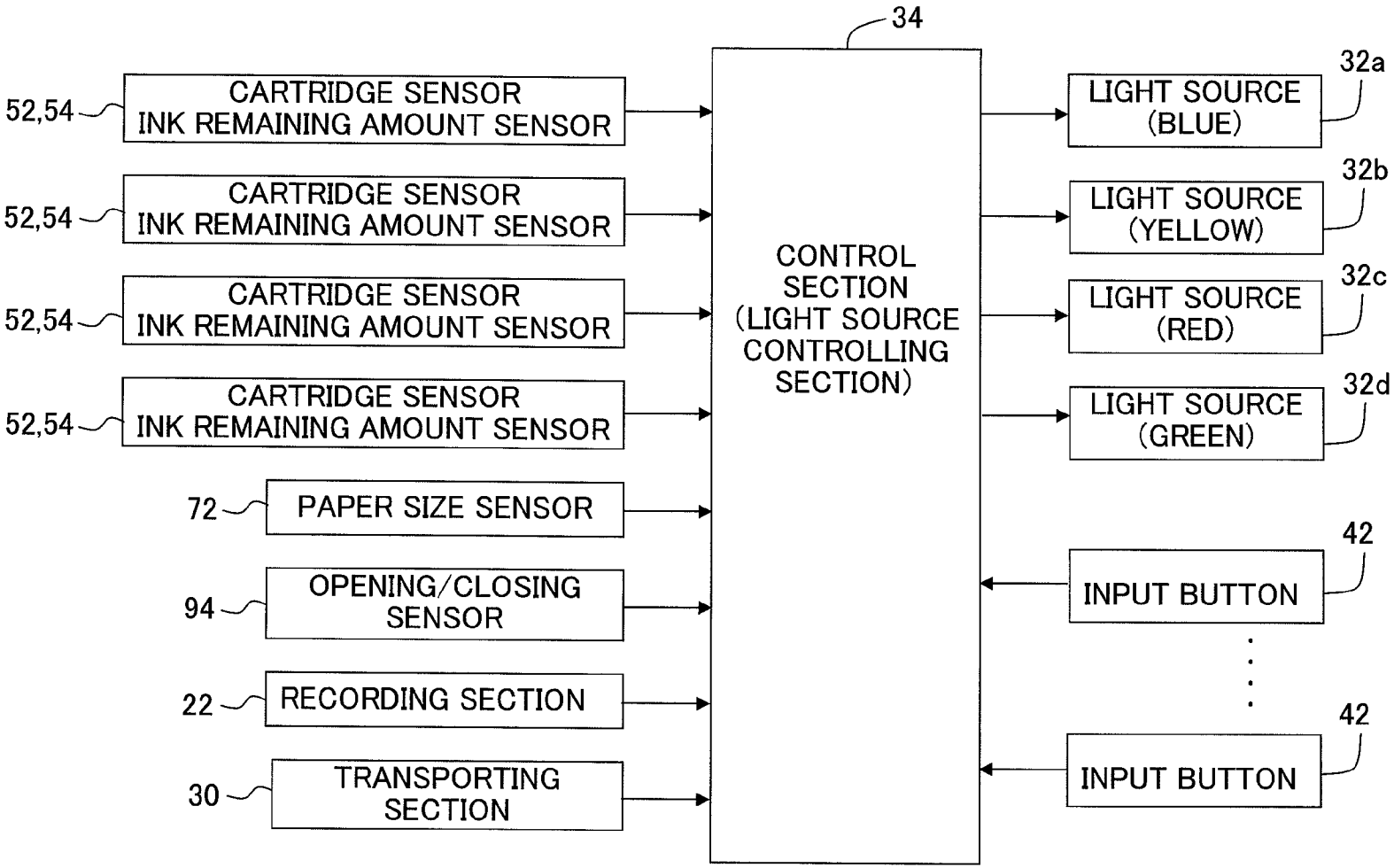
FIG. 4 is a block diagram showing the structure of the ink-jet recording apparatus according to the first embodiment.

As shown in FIG. 4, the control section 34 functions as "a light source controlling section" which controls a timing at which each of the light sources 32*a* to 32*d* is turned on and a timing at which each of the light sources 32*a* to 32*d* is turned off based on signals provided from various sensors, etc. In particular, the control section 34 has a central processing unit (CPU) performing various arithmetic processes, a memory device (ROM, RAM) storing various types of data, a timer, etc. The control section 34 is connected with the cartridge sensors 52, the ink remaining amount sensors 54, the paper size sensor 72, an opening/closing sensor 94, the recording section 22, the capping device 24, the transporting section 30, input buttons 42, and the light sources 32*a* to 32*d*, etc.

Next, a structure of the scanner section 14 will be described. As shown in FIG. 3, the scanner section 14 has a second housing 100 in a substantially rectangular parallelepiped shape. A platen glass 102, on which a document is placed, is provided on an upper surface of the second housing 100. An image sensor 104, which scans an image of the document, is provided in the second housing 100. Further, a cover 106 covering the platen glass 102 is attached in an openable/closable manner via a second hinge 108. As described above, the light-reflecting member 90 and the light-reflecting member 92 are provided at the lower surface 14*a* of the scanner section 14.

The scanner section 14 is attached to the upper portion of the first housing 20 of the printer section 12 via a first hinge 110. The scanner section 14 functions as a lid body (cover), thereby opening/closing the opening 35 of the first housing 20. Further, the opening/closing sensor 94 recognizing whether the scanner section 14 is opened or closed is provided at one of the printer section 12 and scanner section 14 (the printer section 12 in this embodiment).

Next, a recording operation of the ink-jet recording apparatus 10 will be described. The ink-jet recording apparatus 10 performs "the recording operation" for recording the image onto the paper 16 in a state that the scanner section 14 as "the lid body" is closed. In this "recording operation", the paper 16 accommodated in the paper cassette 26 is transported to the recording section 22 by the transporting section 30, and then the ink is jetting from the recording head 46 onto the paper 16. Accordingly, the image is recorded onto the paper 16, and the paper 16 on which the image has been recorded is then discharged from above the end portion of the discharge area S1 placed inside the first housing 20 to the paper discharge tray 28. The operation of each of the light sources 32*a* to 32*d* is controlled by the control section 34 as "the light source controlling section". The user is capable of appropriately selecting a necessary operation by operating each of the input buttons 42. In the following, a representative operation will be explained.

In "a first operation", the control section 34 turns at least one of the light sources 32*a* to 32*d* on during the recording operation, and the light from at least one of the light sources is reflected at the light-reflecting member 90 so as to irradiate the discharge area S1. Accordingly, it is easily possible to visually confirm the image of the paper 16 discharged to the paper discharge tray 28 under the light irradiated to the discharge area S1. Thus, it is possible to observe any recording defects at an early stage. Further, during the recording operation, the light sources 32*a* to 32*d* reciprocate together with the carriage 48, thus, it is possible to illuminate throughout a width direction (i.e. scanning direction) of the discharge area S1, like a searchlight. Therefore, even when light sources 32*a* to 32*d* having low power are used, it is easily possible to visually confirm the paper 16 positioned at the discharge area S1 from the opening 36 for taking out the paper.

Upon the completion of "the recording operation", the driving motor 60 (FIG. 1) moves the carriage 48 to the central portion in the scanning direction of the scanning area R. The control section 34 turns at least one of the light sources 32*a* to 32*d* on, and the light of the at least one of the light sources is reflected at the light-reflecting member 90 so as to irradiate the discharge area S1. Accordingly, the user sees that at least one of the light sources in a state of being turned on is positioned at the central portion in the scanning direction, thus, it is possible for the user to know "the completion of the recording operation". In addition, the user is easily capable of taking out the paper 16 which is on the paper discharge tray 28 and is illuminated by the light from at least one of the light sources while visually confirming the paper 16.

After a certain period of time upon the completion of "the recording operation", the driving motor 60 (FIG. 1) moves the carriage 48 to the standby position P1 and the carriage 48 positions the recording head 46 at the predetermined capping position P2. Further, the control section 34 turns at least one of the light sources 32*a* to 34*d* on for a certain period of time, and the light of at least one of the light sources is reflected at one of the light-reflecting members 90 and 92 so as to irradiate the discharge area S1. That is, the light of at least one of the light sources 32*a* to 32*d* is reflected at the light-reflecting member 90 so as to irradiate the discharge area S1 until the carriage 48 moves to the standby position P1. After the movement of the carriage 48 to the standby position P1, the light of at least one of the light sources 32*a* to 32*d* is reflected at the light-reflecting member 92 so as to irradiate the discharge area S1. Then, all of the light sources 32*a* to 32*d* are turned off.

Therefore, the discharge area 51 is illuminated with the light of at least one of the light sources 32*a* to 32*d* for the certain period of time upon the completion of "the recording operation". Thus, even after the carriage 48 is moved to the standby position P1, the user is easily capable of taking out the paper 16 discharged on the paper discharge tray 28 while visually confirming the paper 16. Further, after a certain period of time upon the movement of the carriage 48 to the standby position P1, all of the light sources 32*a* to 32*d* are turned off. Thus, it is possible to reduce power consumption of the light sources 32*a* to 32*d*.

In another operation, all of the light sources 32*a* to 32*d* may be turned off during the recording operation. Even in this case, the control section 34 turns at least one of the light sources 32*a* to 32*d* on after the completion of "the recording operation", thus, it is possible to irradiate the light to the discharge area S1. Accordingly, the user is easily capable of taking out the paper 16 discharged on the paper discharge tray 28 while visually confirming the paper 16. Further, in a further operation, each of the light sources 32*a* to 32*d* may be kept in a state of being turned on after the completion of "the recording operation", until an input button, among the various input buttons 42, for turning off the light sources is pushed.

"A second operation" is the operation which is added to "the first operation". In "the second operation", the light sources 32*a* to 32*d* emitting lights of different colors corresponding to different operation states are selectively turned on by the control section 34.

For example, when the ink remaining amount sensor 54 of one of the ink cartridges 44*a* to 44*d* detects that the ink in one of the ink cartridges 44*a* to 44*d* is less than a predetermined reference value, the control section 34 selects and turns on one light source, among the light sources 32*a* to 32*d*. The color of the light source, which is selected and turned on, corresponds to the color of the ink cartridge having the ink less than the predetermined reference value. Thus, the user is easily capable of knowing the type (color) of the ink cartridge required to be replaced and replacement timing thereof, on the basis of the color of the light source in a state of being turned on.

The control section 34 may turn one of the light sources having respectively different colors on, depending on the number of remaining paper sheets. For example, in a case that the number of remaining sheets of the paper 16, as the recording objective, is 20 sheets, the control section 34 turns the light source emitting blue light on, in a case that the number of remaining sheets of the paper 16 is 10 sheets, the control section 34 turns the light source emitting yellow light on, in a case that the number of remaining sheets of the paper 16 is 3 sheets, the control section 34 turns the light source emitting red light on. Thus, the user is capable of knowing approximately how long it takes to complete "the recording operation", on the basis of the color of the light source in a state of being turned on.

In "the second operation", the operation state is indicated by the color of the light source. In other operations, however, the operation states may be indicated, for example, by flashing one of the light sources on and off or changing a flashing cycle of one of the light sources, instead of turning each of the light sources having respectively different colors on. In this case, regardless of the number of colors of the light sources, it is possible to indicate various operation states. Accordingly, just one light source is also enough to indicate various operation states.

"A third operation" is the operation for preferentially improving the workability for taking out the paper 16 which is less than a predetermined value in size. In "the third operation", at least when a size of the paper 16, recognized by the paper size sensor 72 as "the size recognition mechanism", is not more than the predetermined value (for example, less than the postcard size), the control section 34 controls the light sources 32*a* to 32*d* to perform the first and second operations.

In "a first method" for achieving "the third operation", the size of the paper 16 (including a minimum size), for which the irradiation of the light is required at the discharge area S1 in the first housing 20, is previously stored in the memory device of the control section 34. Then, the control section 34 turns at least one of the light sources 32*a* to 32*d* on, only when the image is recorded on the paper 16 having the size stored in the memory device.

In "a second method", the predetermined value of the size of the paper 16 is previously stored in the memory device of the control section 34. Then, the control section 34 turns at least one of the light sources 32*a* to 32*d* on, only when the image is recorded on the paper 16 having the size not more than the predetermined value stored in the memory device.

In a case that the user inputs the paper size manually, it is possible to use, as "the size recognition mechanism", the input button for inputting the paper size among the various input buttons 42 and the control section 34 recognizing the inputted size.

Next, a standby operation of the ink-jet recording apparatus 10 will be described. In a case that the ink-jet recording apparatus 10 is put in the standby state or that the purge operation is performed, "the standby operation" is performed. In the standby operation, the driving motor 60 (FIG. 1) moves the carriage 48 to the standby position P1 and the carriage 48 positions the recording head 46 at the predetermined capping position P2. Then, the lifting section 66 of the capping device 24 lifts the head cap 64 and the head cap 64 is placed on the recording head 46. Further, in the purge operation, the suction pump (not shown) sucks the ink in the recording head 46.

As described in "the first operation", in a state that the carriage 48 is positioned at the standby position P1, the light emitted from the light source 32*a* is reflected at the light-reflecting member 92 so as to irradiate the discharge area S1. Accordingly, when the paper 16 is left (remained) on the paper discharge tray 28, the user is easily capable of taking out the paper 16 while visually confirming the paper 16.

In this embodiment, in a case that the carriage 48 is positioned at the standby position P1, only the light source 32*a* positioned nearest to the discharge area S1 is used in order to efficiently guide the light, which is emitted when the carriage 48 is positioned in the standby position P1, to the discharge area S1. However, other light sources 32*b* to 32*d* may be used independently and more than one light source may be used in combination.

Next, a replacement operation of ink cartridges 44*a* to 44*d* will be described. In the replacement operation of ink cartridges 44*a* to 44*d*, in a case that the user manually operates a button for cartridge replacement among the input buttons 42, or in a case that the opening/closing sensor 94 recognizes that the scanner section 14 is opened, the driving motor 60 moves the carriage 48 to the central portion (position shown in FIG. 2) of the scanning area R. Then, the carriage 48 positions the ink cartridges 44*a* to 44*d* at a predetermined cartridge replacement position P3. Further, the control section 34 as "the light source controlling section" turns at least one of the light sources 32*a* to 32*d* on and the light emitted from at least one of the light sources is irradiated to the carriage area S2.

Figure 7:
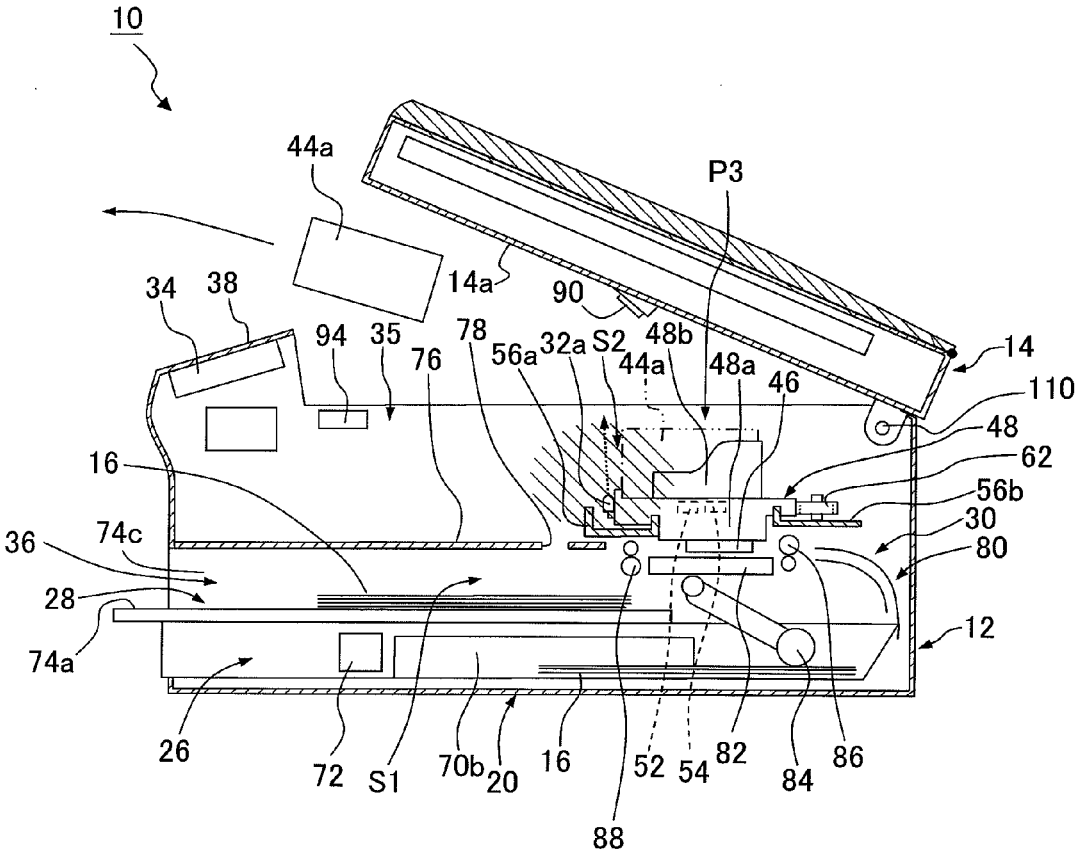
FIG. 7 is a cross-sectional view showing "a state when an ink cartridge is replaced" of the ink-jet recording apparatus according to the first embodiment.
Figure 8:
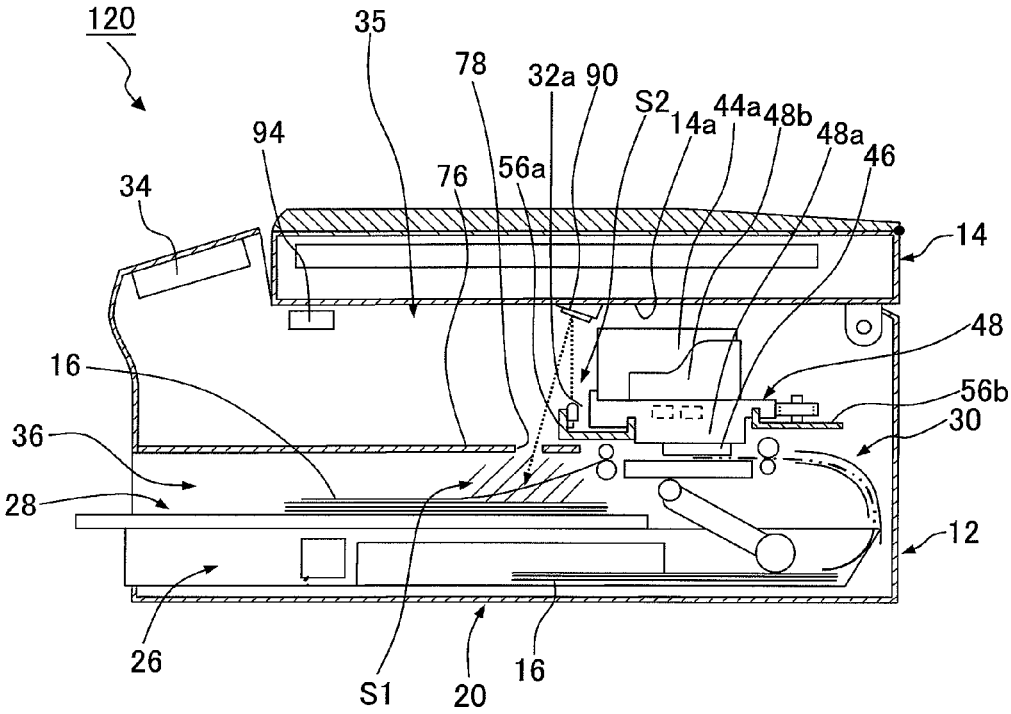
FIG. 8 is a cross-sectional view showing a structure of an ink-jet recording apparatus according to a second embodiment.

Accordingly, as shown in FIG. 7, the ink cartridges 44*a* to 44*d* are illuminated with the light emitted from at least one of the light sources in a state that the scanner body 14 as "the lid body" is opened. Thus, the user is easily capable of replacing the ink cartridges 44*a* to 44*d* while visually confirming the positions of the ink cartridges 44*a* to 44*d*. Further, as described above, if the light source, the color of which corresponds to that of the ink cartridge having a small amount of ink, is turned on, the user is easily capable of knowing the type (color) of the ink cartridge required to be replaced based on the color of the light source. Therefore, it is possible to replace the ink cartridge more easily.

As shown in FIG. 7, in a case that the scanner section 14 as "the lid body" is in a state of being opened, and that the empty ink cartridge 44*a* is taken out of the cartridge holder 48*b*, the cartridge sensor 52 associated with the ink cartridge 44*a* detects that the ink cartridge 44*a* is not installed to the cartridge holder 48*b*. The control section 34, then, turns the light source corresponding to the ink cartridge 44*a* taken out of the cartridge holder 48*b* on or turns at least one of the other light sources on. Then, in a case that a new ink cartridge 44*a* is installed to the cartridge holder 48*b*, that the cartridge sensor 52 associated with the ink cartridge 44*a* detects "the ink cartridge 44*a* is installed to the cartridge holder 48*b*", and that the ink remaining amount sensor 54 associated with the ink cartridge 44*a* detects "the ink in the ink cartridge 44*a* is more than the predetermined reference value", the control section 34 turns the light source, which has been turned on, off.

Therefore, when the user sees the light source is turned off, the user is capable of judging that the ink cartridge 44*a*, which is new and contains a sufficient amount of ink, is properly installed.

Next, a second embodiment will be described. In an ink-jet recording apparatus 120, light sources 32*a* to 32*d* are attached at a central portion of a first rail 56*a* in a longitudinal direction (i.e. scanning direction). A light-reflecting member 90, by which a light emitted from each of the light sources 32*a* to 32*d* is reflected to irradiate a discharge area S1, is provided at a lower surface 14*a* of a scanner section 14. In a case that ink cartridges 44*a* to 44*d* are replaced, a carriage 48 is moved to a central portion of a scanning area R and the ink cartridges 44*a* to 44*d* are positioned at a predetermined cartridge replacement position P3 positioned in the vicinity of the light sources 32*a* to 32*d*.

Accordingly, in a state that the scanner section 14 is closed, it is possible to irradiate the light emitted from each of the light sources 32*a* to 32*d* to the discharge area S1 in a first housing 20 through a light guide opening 78. On the other hand, in a state that the scanner section 14 is opened, it is possible to irradiate the light emitted from each of the light sources 32*a* to 32*d* to a carriage area S2. Thus, it is possible to improve the workability when a paper 16 is taken out from a paper discharge tray 28 and improve the workability when the ink cartridges 44*a* to 44*d* are replaced.

In the second embodiment, the light sources 32*a* to 32*d* are fixed to the first rail 56*a*. Accordingly, the light-reflecting member 90 may be provided only the position at which the light-reflecting member 90 faces the light sources 32*a* to 32*d*. The light guide opening 78 may be provided only the position at which the light guide opening 78 corresponds to the light-reflecting member 90.

Next, a third embodiment will be described. In an ink-jet recording apparatus 130, since light sources 132*a* to 132*d* have low directivities, lights emitted from the light sources 132*a* to 132*d* are uniformly diverged or diffused to all directions. Therefore, the light sources 132*a* to 132*d* are disposed in the vicinity of the light guide opening 78, thus, it is possible to simultaneously illuminate both a discharge area S1 and a carriage area S2. Thus, light-reflecting members 90 and 92 are omissible.

Figure 9:
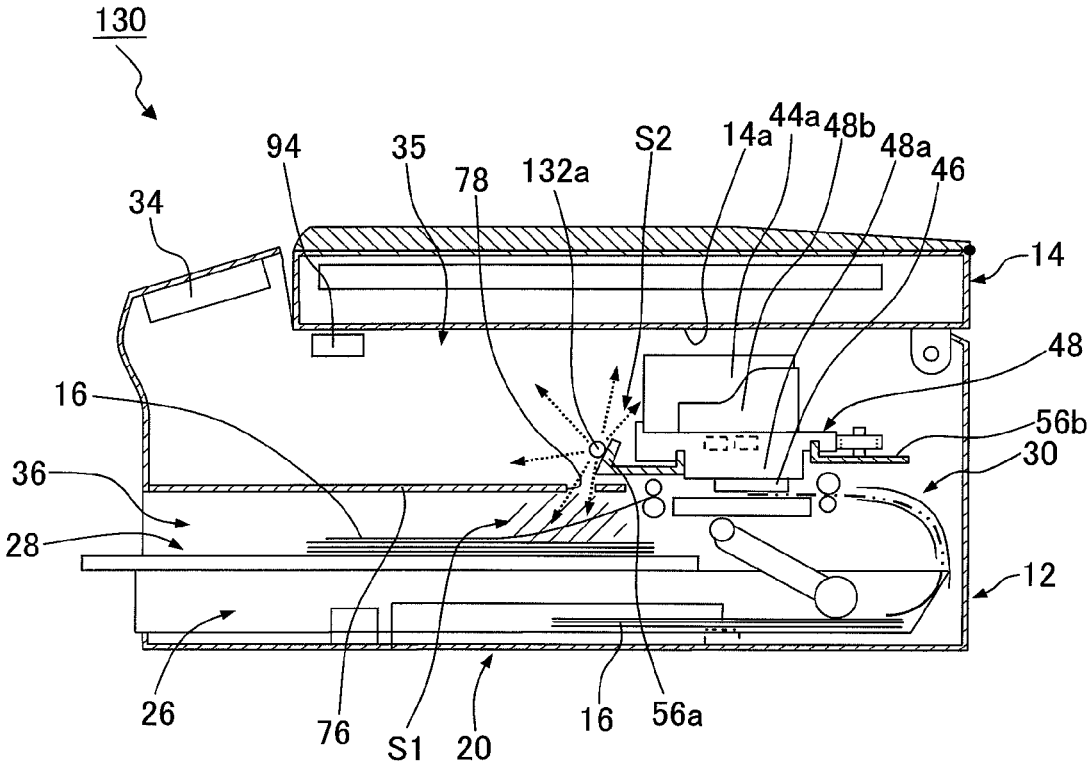
FIG. 9 is a cross-sectional view showing a structure of an ink-jet recording apparatus according to a third embodiment.

In the ink-jet recording apparatus 130 (FIG. 9), the light sources 132*a* to 132*d* are placed on the first rail 56*a*. The light sources 132*a* to 132*d*, however, may be placed on a carriage 48.

In the embodiments described above, the light guide opening 78 as the light guide section guiding the light from each of the light sources to the discharge area S1 is formed in the partition plate 76. The light guide section, however, is not limited to this. For example, a portion corresponding to the light guide opening 78 of the partition plate 76 may be formed of a light-transmissive material instead of the opening. The partition plate 76 may be formed entirely of the light-transmissive material.

In the above explanation, examples are described in which the present invention is applied to the ink-jet recording apparatus which jets the ink onto the paper to record the image, but the present invention is also applicable to other recording apparatuses in which a liquid other than ink is jetted onto a recording medium to record the image.

What is claimed is:

1. An ink jet recording apparatus which jets an ink onto a recording medium to record an image, comprising:

a housing which has an opening at an upper portion thereof;

a carriage which reciprocates in the housing and carries an ink cartridge which contains the ink and a recording head which jets the ink;

a tray, at least a portion of which is provided in the housing and on which the recording medium, on which the image has been recorded by the ink jetted from the recording head, is discharged;

a cover which is provided on the upper portion of the housing and opens/closes the opening;

a light source which is provided so that both a carriage area in which the carriage is positioned when the ink cartridge is replaced and a discharge area, of the tray, in which the recording medium is discharged are irradiated with a light from the light source; and a partition plate which has a light guide section and is provided in the housing between the light source and the tray, wherein the light from the light source irradiates the portion of the discharge area in the housing via the light guide section, wherein the light source is disposed between the partition plate and the opening, and wherein the light from the light source irradiates a portion of the discharge area in the housing when the cover is closed and irradiates the carriage area when the cover is opened.

2. The ink jet recording apparatus according to claim 1, wherein the housing is constructed such that the portion of the discharge area in the housing can be seen from outside the housing.

3. The ink jet recording apparatus according to claim 1, further comprising:

a size recognition mechanism which recognizes a size of the recording medium; and a light source controlling section which controls the light source to irradiate the discharge area with the light at least when the size of the recording medium recognized by the size recognition mechanism is not more than a predetermined value.

4. The ink jet recording apparatus according to claim 1, further comprising a light-reflecting member which is provided on a surface of the cover facing the carriage area, wherein the light emitted from the light source is reflected at the light-reflecting member to irradiate the discharge area when the cover is closed.

5. The ink jet recording apparatus according to claim 4, wherein the light source is provided in the carriage.

6. The ink jet recording apparatus according to claim 5, further comprising a capping device having a head cap which covers the recording head at a predetermined capping position, wherein, in a state that the cover is closed, the carriage positions the recording head at the capping position and the light source irradiates the discharge area with the light after a recording operation is completed.

7. The ink jet recording apparatus according to claim 6, wherein the light source includes a plurality of light sources having different emission colors and the plurality of light sources are selectively turned on depending on an operation state of the ink jet recording apparatus.

8. The ink jet recording apparatus according to claim 1, wherein, in the state that the cover is closed, the light from the light source irradiates the discharge area during a recording operation of the recording head.

9. The ink jet recording apparatus according to claim 1, wherein, in the state that the cover is closed, the light from the light source irradiates the discharge area after a completion of a recording operation of the recording head.

10. The ink jet recording apparatus according to claim 1, further comprising:

a light source controlling section which controls a timing at which the light source is turned on and a timing at which the light source is turned off;

an ink remaining amount detecting section which detects an ink remaining amount in the ink cartridge; and a cartridge detecting section which detects an absence or a presence of the ink cartridge in a cartridge holder provided in the carriage, wherein, in a state that the cover is opened, when the cartridge detecting section detects the absence of the ink cartridge, the light source controlling section turns the light source on, and then, when the cartridge detecting section detects the presence of the ink cartridge and the ink remaining amount detecting section detects that the ink remaining amount in the ink cartridge is not less than a predetermined reference value, the light source controlling section turns the light source off.

11. The ink jet recording apparatus according to claim 1, wherein the light guide section is another opening which is formed in the partition plate and extends in a moving direction of the carriage.

12. The ink jet recording apparatus according to claim 1, further comprising a light-reflecting member disposed on a surface of the cover facing the carriage area and configured to reflect the light emitted from the light source to irradiate the discharge area when the cover is closed, wherein the light-reflecting member, the light guide section, and the portion of the discharge area are positioned to be aligned in a straight line.

13. The ink jet recording apparatus according to claim 1, wherein the light source, the light guide section, and the portion of the discharge area are positioned to be aligned in a straight line.

* * * * *